US011046912B2

(12) United States Patent
Thangaraj

(10) Patent No.: US 11,046,912 B2
(45) Date of Patent: Jun. 29, 2021

(54) CLEANING SOLUTION

(71) Applicant: Sipka Inc., Middlesex, NJ (US)

(72) Inventor: John Appadurai Thangaraj, Edison, NJ (US)

(73) Assignee: Sipka Inc., Middlesex, NJ (US)

( * ) Notice: Subject to any disclaimer, the term of this patent is extended or adjusted under 35 U.S.C. 154(b) by 0 days.

(21) Appl. No.: 16/508,975

(22) Filed: Jul. 11, 2019

(65) Prior Publication Data

US 2020/0017802 A1 Jan. 16, 2020

Related U.S. Application Data

(60) Provisional application No. 62/697,112, filed on Jul. 12, 2018.

(51) Int. Cl.

| | |
|---|---|
| ***C11D 3/43*** | (2006.01) |
| ***C11D 1/29*** | (2006.01) |
| ***C11D 1/72*** | (2006.01) |
| ***C11D 3/50*** | (2006.01) |
| ***C11D 3/20*** | (2006.01) |
| ***C11D 3/12*** | (2006.01) |
| ***C11D 7/28*** | (2006.01) |
| ***C11D 3/40*** | (2006.01) |

(52) U.S. Cl.

CPC ..... *C11D 1/29* (2013.01); *C11D 1/72* (2013.01); *C11D 3/1213* (2013.01); *C11D 3/2065* (2013.01); *C11D 3/2068* (2013.01); *C11D 3/40* (2013.01); *C11D 3/50* (2013.01); *C11D 7/28* (2013.01)

(58) Field of Classification Search

CPC ..... C11D 3/48; C11D 11/0023
USPC ..... 510/309
See application file for complete search history.

(56) References Cited

U.S. PATENT DOCUMENTS

| | | | | |
|---|---|---|---|---|
| 4,087,387 | A | 5/1978 | Willems et al. | |
| 4,554,083 | A | 11/1985 | Soldanski et al. | |
| 5,700,312 | A | 12/1997 | Fausnight et al. | |
| 5,782,962 | A | 7/1998 | Burke et al. | |
| 5,882,387 | A | 3/1999 | Martin et al. | |
| 5,925,607 | A | 7/1999 | Flanagan | |
| 6,051,155 | A | 4/2000 | Hocken et al. | |
| 6,136,775 | A | 10/2000 | Strout et al. | |
| 6,503,136 | B1 | 1/2003 | Rose et al. | |
| 6,531,440 | B1 | 3/2003 | White | |
| 7,381,250 | B2 | 6/2008 | Hasinovic et al. | |
| 7,939,488 | B2 * | 5/2011 | Scheuing | C11D 1/83 510/340 |
| 8,747,570 | B2 | 6/2014 | Hodge et al. | |
| 9,834,443 | B2 | 12/2017 | Thangaraj et al. | |
| 2003/0180229 | A1 * | 9/2003 | Kosti | A61K 8/8111 424/53 |
| 2005/0085407 | A1 | 4/2005 | Oldenhove et al. | |
| 2005/0282714 | A1 | 12/2005 | Oldenhove et al. | |
| 2006/0216256 | A1 * | 9/2006 | Giniger | A61Q 11/00 424/70.1 |
| 2009/0074881 | A1 * | 3/2009 | Kielbania, Jr. | A01N 37/36 424/616 |
| 2010/0234271 | A1 * | 9/2010 | Scheuing | C11D 3/33 510/465 |
| 2011/0150748 | A1 | 6/2011 | Thangaraj | |
| 2014/0060583 | A1 * | 3/2014 | Riddle | C11D 3/08 134/18 |
| 2015/0335598 | A1 * | 11/2015 | Buchalova | A01N 37/02 514/574 |
| 2016/0263062 | A1 * | 9/2016 | Liebowitz | A61K 9/0041 |

* cited by examiner

*Primary Examiner* — Gregory E Webb
(74) *Attorney, Agent, or Firm* — Kaplan Breyer Schwarz, LLP

(57) ABSTRACT

A cleaning formulation includes water in an amount in the range of about 95 to about 99 weight percent, non-volatile polyols in an amount in the range of about 0.1 to about 3.0 weight percent, and surfactant in an amount in the range of about 0.001 to about 2.0 weight percent. The surfactant is not limited to non-ionic surfactants and the ingredients are derived from natural sources or food-grade materials.

22 Claims, No Drawings

CLEANING SOLUTION

STATEMENT OF RELATED CASES

This case claims priority to U.S. Pat. App. 62/697,112 filed Jul. 12, 2018, and which is incorporated by reference herein.

FIELD OF THE INVENTION

The present invention relates to cleaning solutions, and more particularly to a liquid composition for dusting and rejuvenating.

BACKGROUND

Wipe-on surface cleaning and polishing formulations are widely available. They are used to clean surfaces made from plastic, vinyl, wood, metal, rubber, leather, and the like, as typically found in automobiles, the home, literally anywhere. To enhance the appearance of surfaces to which they are applied, most such products include wax (e.g., synthetic or natural), oils (e.g., synthetic or natural), silicones, and/or mixture emulsions that contain volatile organic compounds such as hydrocarbons, organic phenols, ethers, amines, and ethanol or isopropyl alcohol.

Although such formulations work as intended, they do have drawbacks. In particular, the waxes, oils, silicones, and emulsions present in these products coat surfaces as one or more thin layers, and result in very glossy, sticky, and oily surfaces. Consequently, dust, dirt and grease tends to stick to and accumulate on such treated surfaces. This tendency to accumulate dust and dirt increases the frequency of cleaning. And a surface that is too glossy may actually lose its original appearance.

Moreover, the volatile organic compounds that are often present in these formulations (as solvents) can be skin and/or eye irritants, or otherwise toxic. Furthermore, due to the presence of these volatile compounds, such formulations emit odors, which are often undesirable for many users. To mask these odors, fragrances are typically added. But that, of course, does nothing to limit user exposure to the volatile chemicals.

U.S. Pat. No. 4,087,387 discloses a mild aqueous liquid foam cleaning composition for cleaning the interiors of vehicles and buildings. The cleaning composition comprises high-foaming ionic surfactant, alkali metal, ammonium salt of an alkyl benzene sulfonic acid, sodium alkyl sulfuric acid, non-ionic surfactant, alkylphenol polyethers, amphoticeric detergent, isopropyl alcohol, sodium meta silicate, organic builder and water. The preferred pH of the final diluted solution is 7.5-9.5.

U.S. Pat. No. 4,554,083 discloses a leather-care composition comprising wax, lanolin, aliphatic polyurethane resin, polymeric polycarboxylic acid, non-ionic emulsifier, hydroxyalkylamine, perfume oils, preservatives, foam inhibitors, emulsifying aids, dyes and liquid flow promoter. The leather-care solution has pH of 7-8. U.S. Pat. No. 5,700,312 discloses an auto finish-treating composition for paint, metal, vinyl and other plastic finishes comprising micronized wax dispersed in a water/organic solvent emulsion, also containing silicone liquid emulsified in both organic and aqueous phases.

U.S. Pat. No. 5,782,962 discloses a surface protective composition for use on painted automobile surfaces, thermoset and thermoplastic polymers, and rubber and leather goods. The composition comprises a fluorine-containing polymer, micronized wax, a hydrocarbon solvent, an organosilicone compound, a surfactant and water. U.S. Pat. No. 5,882,387 discloses a wipe-on polish composition that contains neither wax nor abrasive components. The polish comprises an oil in emulsion that contains an organopolysiloxane and a volatile solvent. U.S. Pat. No. 5,925,607 discloses a furniture cleaning and polishing composition that contains water-repelling halofluoro polymer, mineral oil, hydrocarbon solvent, silicone oil, surfactant and water.

U.S. Pat. No. 6,051,155 discloses a composition for treating wood and leather surfaces. It contains wax with micronized crystalline titanium dioxide doped with alumina or zirconia, and benzophenone. U.S. Pat. No. 6,136,775, discloses an absorbent wipe impregnated with non-toxic, oil-based cleaning solvent comprised of d-limonene, mineral oil and hydrophilic surfactants for removing oil-based soils such as oil, grease, tar, ink and similar contaminants. It contains a scented, non-toxic solvent.

U.S. Pat. No. 6,503,136 discloses a cleaner and polish for absorbing and retaining fluid on a surface, where one side of the surface is abrasive for cleaning and the other side is nonabrasive for polishing. The formulation comprises an aqueous emulsion (water, surfactant, organic solvent, and a polishing-action agent). More particularly, the formulation includes: 1) an aqueous cleaning emulsion composed of organic solvents such as mineral spirits and aliphatic solvents, 2) a polishing agent, preferably from an organic polysiloxane fluid mixed with water, 3) organic solvent, such as propylene glycol monomethyl ether to remove dirt and contaminants and 4) a preservative, such as ethylene glycol, propylene glycol and/or polyol. In addition to functioning as a preservative for emulsion, propylene glycol can also act as a solvent and provide temperature stability to the formulation. A special precaution is required to handle and dispose of the wiped materials, and the formulation may present a health hazard due to the evaporation of volatile organic solvents.

U.S. Pat. No. 6,531,440, discloses a liquid protectant composition for rubber, synthetic plastic and vinyl surfaces. The composition comprises a cleaning agent, silicone, a thickener, a neutralizing agent, an UV light absorber and water. The composition includes a fragrance and a fragrance stabilizer. The composition has a viscosity ranging from 7600 cPs to 18000 cPs, which supposedly enables the composition to be applied easily to a variety of surfaces and provide a finish that is not excessively glossy and that does not attract dust.

U.S. Pat. No. 7,381,250 discloses a protectant and cleaner liquid composition comprising a cationic micro-emulsion of a natural wax (carnauba wax) nanometer-sized particles, and zinc oxide nanometer-sized particles in combination with a quaternary siloxane compound. The composition includes: 1) wax emulsion TOMAH C-340 composed of Ethylene glycol; amines hydrogenated tallow alkyl, ethoxylated acetate (salt); Carnauba wax and water, 2) Quaternary silicone as a thickener and to improve the deposition of other materials, such as coating conditioning agents, and also provides gloss enhancement, quick drying and antistatic properties to the spray wax formulation. This invention utilizes commercially available TEGO POLISH ADDITIVE Q70 comprised of 2-propanol, 1-butoxy solvents, 3) Zinc Oxide for UV protection, 4) Glycerin, 5) fragrance and 6) preservative. The glycerin content, which represents about 10 percent of the formulation, is added for stabilizing the moisture content of the product and to aid dispersion and clarity of wax in the product. There are several organic components added in this product that release volatile compounds and cause odor.

US 2005/0282714 and US 2005/0085407 disclose a dust-control wipe, and dust-control composition comprising a water-insoluble substrate, a dust-control composition, and an anionic surfactant. The dust-control composition is selected from the group consisting of alkylamine metholamine methosulfate and choline.

U.S. Pat. No. 8,747,570 discloses bio-based glass-cleaning compositions in concentrate form, comprising primarily glycerine, an alkyl polyglycoside, and water. This patent discloses that glass cleaners are often available in a form that is ready-to-use to control the presence of "hardness" in the water used to prepare it. Such hardness, which is defined as the concentration of multivalent cations, has a tendency to cause precipitation of certain components of the solution, particularly in the presence of anionic surfactants, and may also lead to streaking on glass surfaces. This patent also discloses that glass cleaners also include volatile organic compounds (VOCs), which have been subject to regulation. According to the patent, the concentrated glass-cleaning compositions disclosed therein are substantially free of VOCs and further can use dilution water, even when hardness is present, yet result in low streaking and little to no build-up on a glass surface. In particular, the presence of alkyl polyglycoside, which is a bio-based, non-ionic surfactant, enables the use of hard water as a diluent without the associated drawbacks (build-up and streaking) thereof. Glycerine, which is used as a glide aid or lubricant, is a non-VOC. In addition to addressing the VOC issue, the lubricity of glycerin aids in reducing streaking.

SUMMARY

The present invention provides a cleaning solution that avoids some of the costs and disadvantages of the prior art. A cleaning solution in accordance with the present teachings includes three major ingredients: 1) water and 2) non-volatile polyols, and 3) surfactant. These ingredients are derived from natural sources or food-grade materials; in other words, they are safe for humans as well as the environment. The final cleaning solution contains about 90-99+ wt % water, and preferably greater than about 98 wt % water. Formulations in accordance with the invention have a very long shelf life over a normal range of temperature variations. The manufacturing process is simple; the ingredients are mixed at room temperature.

Some embodiment of the invention provide a very mild cleaning, water-based solution including C3 polyols as solvent and one or more surfactants to remove any light dirt and/or dust. The product is not useful for heavy duty cleaning. But for light cleaning duties, embodiments of the invention are useful for cleaning and restoring the look of surfaces, including, for example and without limitation, plastic, laminates, wood, leather, synthetic leather, vinyl, metal, rubber, polyurethanes, acrylic and any other polymeric surfaces, painted surfaces, natural stone (e.g., marble, granite, etc.), and synthetic stone. The formulation is intended to clean and condition the following surfaces, in addition to any others:

vehicle interiors (automobile, airplane, ships, etc.);

furniture or other surfaces that accumulate dust in the home or outside of the home (e.g., office, restaurant, hotels, hospitals, schools, laboratory, etc.); and tiles, counter tops, cabinets.

In use, the cleaning solution is sprayed on an applicator, such as microfiber or other type of soft cloth, a sponge, etc., or directly on the surface to be cleaned, and then the surface is simply wiped. The cleaning solution dries very quickly after application and leaves a surface that is smooth and silky to the touch. This treatment removes dirt, grease, dust and restores the look of the surface. Furthermore, because the applied solution does not tend to trap dust and dirt, there is a limited amount of dust and dirt buildup, thereby making subsequent cleaning easier.

In some additional embodiments, antibacterial and/or oxidizing properties are imparted to the cleaning solution, such as by the addition of chlorine dioxide, hydrogen peroxide, sodium percarbonate, etc. This extends the functionality of the cleaning solution, such as for use in conjunction with skin wipes, for use on food-contact surfaces, and for use in hospitals, and in food and pharmaceutical industries, among other applications.

The cleaning solution formulation is characterized as follows:

1) water based;
2) clear/transparent solution (although colorants can optionally be added);
3) non-toxic;
4) includes only non-volatile chemicals;
5) non-irritant for skin and eyes;
6) odor free (although fragrance can optionally be added);
7) food grade and/or natural-resource ingredients (green products);
8) no wax, oils, silicones, emulsion, oxides, metals, or other polishing agents;
9) very simple formulations with as few as 2 and 3 ingredients;
10) low cost ingredients;
11) effective at cleaning and restoring surfaces; and
12) for use on a wide variety of materials.

DETAILED DESCRIPTION

Formulations in accordance with the illustrative embodiment include the following main ingredients:

(1) Water, 95 to 99+ wt % (preferably about 98 to 99+ wt %);
(2) Polyol, 0.1 to 3 wt % (preferably 0.1 to 2 wt %);
(3) Surfactant, 0.001 to 2 wt % (preferably, 0.01 to 0.1 wt %).

Water.

The major ingredient, which functions as a solvent, is water. The purpose of the water is to keep all ingredients solubilized, wet the surface being treated, and to loosen dust and dirt from the surface. In some embodiments, the water is distilled, de-ionized (DI), or otherwise contains low levels of Ca, Mg, and other metals. The presence of Ca, Mg, etc., in the water can result in the precipitation of salts on the treated surface. The pH of the water can range from about 4.0 to about 8.0, depending on its source, and all pH in that range is suitable.

Surfactants.

In some embodiments (i.e., three-primary component embodiments), a very small quantity of water-soluble surfactant is used to clean any dirt or grease from the treated surface. Anionic, non-ionic, cationic and amphoteric surfactants are compatible for use with the solution. Since water hardness is controlled in the present formulations (e.g., through the use of distilled or de-ionized water, etc), there is no limitation on the types of surfactants that can be used. More particularly, there is no requirement to use a non-ionic surfactant, and no proscription against using an anionic surfactant, as preferred for the embodiments of the invention.

In some embodiments, one or more anionic surfactants, including but not limited to sodium lauryl sulfate (SLS), sodium laureth sulfate (SLES), Sodium Lauryl sulfoacetate (SLSA), Sodium cocoyl Isethionate, in amounts ranging from 0.001 to 2.0 weight percent (wt %), were found to be suitable to clean the dust, dirt and grease from the surfaces.

Similarly non-ionic surfactants, such as polysorbital 20, 60 and 80, ethoxylated alcohols (e.g., Bio-Soft EC-639, commercially available from Stepan Co. of Northfield, Ill. and others) and ethoxylated coco amine (Toximul CA-2, commercially available from Stepan Co and others), were also evaluated in concentrations from 0.001 to 2.0 wt % and found to be suitable. Quaternary ammonium salts such as Cetyltrimethylammonium bromide (CTAB), Hexadecyltrimethylammonium bromide (HTAB) and n-alkyl dimethyl benzyl ammonium chloride were also evaluated and found to be suitable up to about 2.0 wt %. The various types of surfactants are suitable for use individually or mixed with the other types of surfactants. The amount of surfactant was evaluated at three levels: "mild" (0.001 to 0.05 wt %), "medium" (0.1 to 2.0 wt %), and "strong" (>2.0 wt %). Concentrations of surfactant higher than 2 wt % were found to be problematic, as discussed later in this specification. Cationic surfactant, such as Quaternary ammonium salts, functions as a disinfectant if added to the present formulations.

Non-Volatile Polyols.

In accordance with the present teachings, the presence of a very small amount of a non-volatile polyol in the formulation results in a very thin, transparent, smooth, and moist coating on surfaces to which the cleaning solution is applied.

In some embodiments, the non-volatile polyol is a C3 diol, C3 triol, or mixtures thereof. In some embodiments, the C3 diol is propylene glycol. It is nontoxic, colorless, odorless, viscous, stable, high boiling and completely soluble in water. It is commonly used in food, cosmetics, and health-care products and as pharmaceutical ingredient. In addition to enhancing surface cleaning and preserving the surface due to the moist environment it provides, propylene glycol reduces surface static, thereby making it easier to remove dust that lands on the treated surface.

In some embodiments, the C3 triol is glycerol (also called "glycerin"). It is colorless, odorless, viscous, sweet-tasting, and non-toxic liquid. It is widely used in the food industry as a sweetener and humectant, and also used in cosmetics, health-care products and pharmaceutical formulations. It is not harmful for humans, animals or the environment. Glycerol, which is bacteriostatic, is derived from vegetable and animal sources, and is inexpensive.

In some embodiments, the present formulations include about 0.1 to about 3 wt %, and most preferably about 0.1 to about 2 wt % C3 diol or C3 triol. Such an amount enhances surface smoothness for wiping the dust and dirt, and also provides a thin, moist coating to rejuvenate the surface. Also, the glycerol coating does not collect dust, thereby facilitating subsequent cleanings. Glycerol is non-volatile compounds and, therefore, odorless. It is highly soluble in water.

Additional polyols, such as polyethylene glycol and polypropylene glycol are also suitable for used in conjunction with the invention. However, these polyols are not compatible for use with certain surfactants because they form a thick emulsion or precipitate.

In some embodiments, the formulation includes one or more of the following: fragrances, color, foaming agent, aerosol and a thickener if needed.

A variety of formulations were prepared, some in accordance with the present teachings, and some not, as summarized in Examples 1-10 below. To the prepare the formulations, ingredients were mixed using a mechanical stirrer for 5 minutes to form a homogenous solution. All compositions are in weight percent. Deionized water pH varied between 5.8 to 8.0, depending on the day of dispense. The distilled water pH varied between 4.0 to 6.5 depending on the source of the water. The pH of the water does not influence product stability or performance.

Example 1

Table I shows a variety of formulations using propylene glycol as the polyol.

TABLE I

Compositions including Water, C3 Diol, and Surfactant

| | Formulation | | | | | | | | | |
|---|---|---|---|---|---|---|---|---|---|---|
| Ingredients | A* | B* | C | D | E | F | G* | H* | I | J |
| SLS | — | — | 0.001 | 0.05 | — | 0.1 | — | 0.1 | — | — |
| SLES | — | 0.05 | — | — | 0.05 | — | 0.1 | — | — | — |
| Polysorbate 80 | — | — | — | — | — | — | — | — | 0.2 | — |
| CTAB | — | — | | | | | — | — | — | 0.2 |
| Propylene Glycol USP | 5.0 | — | 0.1 | 2.0 | 2.0 | 3.0 | 5.0 | 10.0 | 2.0 | 2.0 |
| DI water | 95.0 | 99.95 | 99.899 | 97.95 | 97.95 | 96.9 | 94.9 | 89.9 | 97.8 | 97.8 |
| water pH* | 6.9 | 6.9 | 6.9 | 6.4 | 6.4 | 6.4 | 6.4 | 6.5 | 6.6 | 6.6 |
| Visc., cPs (25° C.) | 1.20 | 1.00 | 1.00 | 1.20 | 1.20 | 1.20 | 1.40 | 1.80 | 1.20 | 1.20 |

Example 2

Table II shows a variety of formulations using glycerol (vegetable-Kosher food grade, USP grade) as the polyol.

TABLE II

| Compositions including Water, C3 Triol, and Surfactant | | | | | | | | | |
|---|---|---|---|---|---|---|---|---|---|
| | Formulation | | | | | | | | |
| Ingredients | A* | B* | C | D | E* | F* | G | H | I |
| SLS | — | 0.05 | 0.001 | 0.05 | — | 0.1 | — | — | — |
| SLES | — | — | — | — | 0.1 | — | — | — | 0.1 |
| Polysorbate 80 | — | — | — | — | — | — | 0.2 | — | — |
| CTAB | — | — | | | | | — | 0.2 | — |
| Glycerol, USP | 5.0 | — | 0.1 | 2.0 | 5.0 | 10.0 | 2.0 | 2.0 | 2.0 |
| Propylene Glycol, USP | — | — | — | — | — | — | — | — | 2.0 |
| Distilled water | 95.0 | 99.95 | 99.899 | 97.95 | 94.9 | 89.9 | 97.8 | 97.8 | 95.9 |
| water pH | 6.7 | 6.8 | 6.7 | 6.8 | 6.8 | 6.6 | 6.8 | 6.4 | 6.8 |
| Visc., cPs (25° C.) | 1.20 | 1.00 | 1.00 | 1.20 | 1.20 | 1.34 | 1.20 | 1.20 | 1.20 |

Tables I and II show a variety of formulations, some of which are embodiments of the invention, and some of which are not (as indicated by "*").

Formulations "A" and "B" in Tables I and II are "comparative examples;" they are not embodiments of the invention. In particular, Formulation "A" does not include surfactant, and although marginally effective at cleaning dust, was ineffective for removing dirt and grease from surfaces. Also, the concentration of polyol is out of range (i.e., >3 wt %). Formulation "B" does not include polyol; it loosened dirt and grease from surfaces, but the treated surface (1) does not develop a "silky smooth" feel, (2) is not anti-static, such that it tends to attract dust, (3) does not develop a sheen, and (4) does not rejuvenate/moisture the surface. Furthermore, as discussed in further detail in conjunction with Example 3 (Table III), Formulations "G" and "H" of Table I, and Formulations "E" and "F" of Table II are also comparative examples; they are not embodiments of the invention.

Formulations "C," "D," "E," "F," "I," and "J" of Table I and formulations "C," "D," "G," "H," and "I" of Table II are embodiments of the invention. These formulations were all effective at removing dirt and grease, improving the look of the surfaces to which they were applied, and did not accumulate dust, etc. As applied, these formulations exhibited minimal if any streaking of the surface and dried rapidly. There was no apparent difference in performance for formulations that included DI water and those that included distilled water. Formulations in accordance with the invention including anionic surfactants, such as SLS or SLES, non-ionic surfactant, such as polysorbate 80, or cationic surfactant, such as cetyltrimethylammonium bromide (CTAB), all performed acceptably.

Example 3

Table III shows formulations that include polyol, but not surfactants, and includes observations as to the effect of increasing levels of polyol. The polyol, which is glycerol in these formulations, uniformly coats the surface and forms a coating layer.

TABLE III

| Compositions without Surfactant | | | | | |
|---|---|---|---|---|---|
| | Formulation | | | | |
| Ingredients | A | B | C | D | E |
| Glycerol, USP | 2.0 | 3.0 | 5.0 | 7.0 | 10.0 |
| DI water | 98.0 | 97.0 | 95.0 | 93.0 | 90.0 |
| Observation after cleaning a phenolic resin surface (laboratory benchtop) | | | | | |
| Visibility of glycerol coating | Forms thin, slightly visible moist coating | Forms thin, slightly visible moist coating | Forms thin, moderately visible moist coating | Forms thin, highly visible moist coating | Forms thin, highly visible moist coating |
| Drying time | <1 min. | <1 min. | >5 min | >15 min | >2 hrs |
| Surface Streaks? | Minimal | Minimal | Moderate | Excessive | Excessive |
| Additional wiping required? | No | No | Yes | Yes, repeated | Yes, repeated |

As polyol concentration increases, the treated surface becomes increasingly slick, lengthening drying times, increasing surface streaking, and requiring repeated wiping with wet towels to remove excess glycerol. Relative humidity levels can exacerbate these issues, wherein higher levels thereof result in problematic performance at relatively lower concentrations of polyol. For these reasons, polyol concentration in the formulation is limited to 3 wt %.

Example 4

Table IV shows formulations in accordance with the invention having varying levels of sodium laureth sulfate (SLES) as surfactant.

TABLE IV

| Compositions with Varying Levels of SLES Surfactant | | | | | |
|---|---|---|---|---|---|
| | Formulation | | | | |
| Ingredients | A | B | C | D | E |
| SLES | 0.1 | 1.0 | 2.0 | 3.0 | 5.0 |
| Glycerol, USP | 2.0 | 2.0 | 2.0 | 2.0 | 2.0 |
| DI water | 97.9 | 97.0 | 96.0 | 95.0 | 93.0 |
| Observation after cleaning the phenolic resin surface (laboratory benchtop) | | | | | |
| Visibility of glycerol coating | Forms thin, slightly visible coating | Forms thin, moderately visible foam coating | Forms thin, moderately visible foam coating | Forms thick, highly visible, foam coating | Forms thick, highly visible, foam coating |
| Foam formation during cleaning? | No | small amt | large amt | large amt | large amt |
| Drying time | <1 min | <1 min | >2 min | >15 min | >15 min |
| Soap residue on surface? | Not visible | Not visible | Slightly visible | Highly visible | Highly visible |
| Surface streaks? | No | No | No | No | No |
| Further wiping and cleaning required? | No | No | Yes, a few times to remove surfactant | Yes, more than for formulation C | Yes, more than for formulation C |

Example 5

Table V shows formulations in accordance with the invention having varying levels of sodium lauryl sulfate (SLS) as surfactant.

TABLE V

| Compositions with Varying Levels of SLS Surfactant | | | | | |
|---|---|---|---|---|---|
| | Formulation | | | | |
| Ingredients | A | B | C | D | E |
| SLS | 0.1 | 1.0 | 2.0 | 3.0 | 5.0 |
| Glycerol, USP | 2.0 | 2.0 | 2.0 | 2.0 | 2.0 |
| DI water | 97.9 | 97.0 | 96.0 | 95.0 | 93.0 |
| Observation after cleaning the phenolic resin surface (laboratory benchtop) | | | | | |
| Visibility of glycerol coating | Forms thin, slightly visible coating | Forms thin, moderately visible foam coating | Forms thin, moderately visible, foam coating | Forms thick, highly visible foam coating | Forms thick, highly visible, foam coating |
| Foam formation during cleaning | No | small amt | large amt | large amt | large amt |
| Drying time | <1 min | <1 min | >2 min | >15 min | >15 min |
| Soap residue on the surface? | Not visible | Not visible | Slightly visible white layer | Highly visible white layer | Highly visible white layer |
| Surface streaks? | No | No | No | No | No |
| Further wiping and cleaning required | No | No | Yes, few times to remove surfactant | Yes, several times to remove surfactant | Yes, several times to remove surfactant |

Tables IV and V show formulations with varying levels of surfactant. In Table IV, the surfactant is SLES; in Table V, the surfactant is SLS. The results for these surfactants were essentially the same. In particular, concentrations of SLES and SLS surfactant in excess of 2 wt % were found to generate increasingly large amounts of foam, which, after drying, formed a thin, white residue layer. The surface required several follow-up cleanings with water to remove the coating.

The cationic surfactant "cetyltrimethylammoinum bromide" (CTAB; shown in Tables I and II) is not soluble above 2 wt % concentration and, like SLES and SLS, tended to form foam and leave a white residue after drying, for higher concentrations. Based on these results, a surfactant concentration of about 2 wt % is considered a maximum acceptable amount, with the surfactant level preferably being Therefore, it is recommended to use surfactants less than 2%, more preferably 1 wt % or less, and most preferably 0.1 wt % or less.

Examples 6 and 7

Tables VI and VII show concentrated versions of the formulation, which facilitate shipping and storage. For use, the concentrated versions of the formulation should be appropriately diluted so that formulation is in the required ranges for water, polyol, and surfactant.

TABLE VI

Concentrated Versions of the Formulation with SLES and C3 Diol

| | Formulation | | | |
|---|---|---|---|---|
| Ingredients | A | B | C | D |
| SLES | 1.0 | 0.5 | 1.0 | 1.0 |
| Propylene Glycol, USP | 20.0 | 25.0 | 50.0 | 70.0 |
| Distilled water | 79.0 | 74.5 | 49.0 | 29.0 |
| water pH | 6.9 | 6.9 | 6.9 | 6.8 |
| Visc., cPs (25° C.) | 2.00 | 2.20 | 4.41 | 5.20 |

For use, the concentrated versions of the formulations shown in Table VI should be diluted (solution:water) as follows: formulations A and B—1:10; formulation C—1:20; and formulation D—1:30.

TABLE VII

Concentrated Versions of the Formulation with SLES and C3 Triol

| | Formulation | | |
|---|---|---|---|
| Ingredients | A | B | C |
| SLES | 1.0 | 0.5 | 1.0 |
| Glycerol, USP | 20.0 | 25.0 | 50 |
| Distilled water | 79.0 | 74.5 | 49 |
| water pH | 6.4 | 6.5 | 6.2 |
| Visc., cPs (25° C.) | 2.00 | 2.20 | 6.21 |

For use, the concentrated versions of the formulations shown in Table VII should be diluted (solution:water) as follows: formulation A—1:10; formulation B—1:10; and formulation C—1:20.

Example 8

Table VIII depicts concentrated versions of the formulation, wherein fragrance and color were added to some concentrated solutions. For use, the concentrated versions of the formulations shown in Table VIII should be diluted (solution:water) as follows: formulation A—1:10; formulation B—1:20; formulation C—1:30; and formulation D—1:40.

TABLE VIII

Concentrated Versions of the Formulation with Fragrance and Color

| | Formulation | | | |
|---|---|---|---|---|
| Ingredients | A | B | C | D |
| SLES | 0.5 | 1.0 | 1.0 | 2.0 |
| Glycerol USP | 25.0 | 50.0 | 70.0 | 80.0 |
| Distilled water | 74.495 | 48.9 | 29.0 | 18.0 |
| Fragrances (methyl Jasmonate) | — | 0.1 | — | — |
| Color (Pylaklor Blue) | 0.005 | — | — | — |

In some alternative embodiments, as illustrated in Examples 9 and 10 below, a formulation in accordance with the present teachings includes disinfectants, either bactericides and/or oxidizers, such as those applying active chlorine (e.g., chlorine dioxide, hypochlorites, chloramines, dichloroisocyanurate, trichloroisocyanurate, wet chlorine, etc.) as well as those applying active oxygen (peroxides, such as hydrogen peroxide, peracetic acid, potassium persulfate, sodium perborate, sodium percarbonate, and urea perhydrate, etc.) Antibacterial formulations of the present cleaning solution can be used in a variety of applications, including, for example and without limitation, skin wipes, food contact surfaces, hospitals, food and pharmaceutical industries, etc.

Example 9

One liter of a solution consisting of glycerin (1%), propylene glycol (1%), SLS (0.05%) and water (97.95%) was prepared. Chlorine-dioxide-generating composition was also prepared in accordance with U.S. Pat. No. 9,834,443, which is incorporated by reference herein. Briefly, that patent discloses that a chlorine-dioxide generating ("CDG") composition is in the form of a dry solid powder, comprising:

- an alkali metal chlorite salt in an amount within the range of about 2 to about 35 weight percent of the CDG composition;
- an acid in an amount within the range of about 2 to about 45 weight percent of the CDG composition;
- a hydrophobic compound in an amount within the range of about 2 to about 20 weight percent of the CDG composition, wherein the hydrophobic compound is, for example and without limitation, hydroxypropyl methylcellulose; and
- a super absorbent in an amount within the range of about 2 to about 15 weight percent of the CDG composition, wherein the super absorbent is, for example and without limitation, high-molecular weight forms of sodium polyacrylate (at least 70,000 g/mol, and more preferably 125,000 to 250,000 g/mol) or sodium polyacrylamide (at least 400 g/mol); and
- optional inert ingredients in an amount to balance.

The CDG composition is formed by drying all ingredients (e.g., 105° C. for 2-3 hours), bringing the temperature of all ingredients to room temperature (c.a. 20-25° C.), and dry blending the ingredients using a v-blender. The CDG composition can be provided in a tablet form (which will require certain excipients, such as binders, disintegrants, lubricants, etc.) or in a loose powder form.

One gram of the CDG composition was added to a porous canister, which was then placed in the solution. After 30 minutes, about 55 ppm of chlorine dioxide was generated in the solution, thereby providing a cleaning formulation with antibacterial properties. The solution was stable for a week.

Additional chlorine dioxide can be generated, as needed, typically at the time of use, by repeating the process described in Example 9 (i.e., generating chlorine-dioxide-generating material, adding it to a release canister, such as, for example and without limitation, any of the porous canisters disclosed in U.S. Publ. Pat. App. 2011/0150748, which is incorporated by reference herein, and then placing it the cleaning formulation. Concentrations of chlorine dioxide (in the solution) in a range from about 0.1 wppm to about 3000 wppm is suitable for use with the aforementioned solution and others in accordance with the present teachings.

Example 10

One liter of a formulation consisting of glycerin (1%), propylene glycol (1%), SLES (0.05%), hydrogen peroxide 0.15%, and water (97.6%) was prepared. This solution was tested and found to be stable for greater than 6 months.

If the formulation of Example 10 is to be used as a skin cleanser, surfactant can be omitted, or surfactants typically used for skin cleansers as known to those skilled in the art (and not previously mentioned herein) may suitably be used. A concentration of hydrogen peroxide in a range from about 0.05 to about 0.5 weight percent are suitable for use with the aforementioned cleaning solution and others in accordance with the present teachings. In an alternative formulation, hydrogen peroxide is replaced by sodium percarbonate, and in the same range of concentration.

It is to be understood that the disclosure describes a few embodiments and that many variations of the invention can easily be devised by those skilled in the art after reading this disclosure and that the scope of the present invention is to be determined by the following claims.

What is claimed:

1. A liquid composition consisting essentially of water in an amount within a range of about 95 to about 99.9 weight percent, surfactant in an amount within a range of about 0.001 to about 2.0 weight percent, and polyol in an amount within a range of about 0.1 to about 3 weight percent, and wherein the liquid composition is not restricted to using only a non-ionic surfactant.

2. The liquid composition of claim 1 wherein the polyol is selected from the group consisting of C3 diol and C3 triol.

3. The liquid composition of claim 2 wherein the C3 triol is glycerol.

4. The liquid composition of claim 1 wherein the polyol is selected from the group consisting of propylene glycol and the combination of glycerol and propylene glycol.

5. The liquid composition of claim 1 wherein the surfactant is an anionic surfactant.

6. The liquid composition of claim 5 wherein the anionic surfactant is selected from the group consisting of sodium lauryl sulfate (SLS), sodium laureth sulfate (SLES), sodium lauryl sulfoacetate (SLSA), sodium cocoyl Isethionate, and mixtures thereof.

7. The liquid composition of claim 5 wherein the anionic surfactant is sodium lauryl sulfate (SLS).

8. The liquid composition of claim 1 wherein the surfactant is selected from the group consisting of a cationic surfactant, a non-ionic surfactant, an amphoteric surfactant, and mixtures of any two or more thereof.

9. The liquid composition of claim 1 further comprising a fragrance in an amount in a range of about 0.0011 to about 0.05 weight percent.

10. The liquid composition of claim 1 further comprising a colorant in an amount in a range of about 0.0001 to about 0.05 weight percent.

11. The liquid composition of claim 1 wherein the pH thereof is in a range of about 4 to 8.5.

12. The liquid composition of claim 1 wherein the amount of water is within a range of about 96 to about 99.9 weight percent and the amount of polyol is within a range of about 0.1 to about 2 weight percent.

13. The liquid composition of claim 1 wherein the amount of water is within a range of about 97 to about 99.9 weight percent and the amount of surfactant is within a range of about 0.01 to about 0.1 weight percent.

14. The liquid composition of claim 1 wherein the amount of water is within a range of about 98 to 99.9 weight percent, the amount of surfactant is within a range of about 0.001 to about 0.1 weight percent, and the amount of polyol is within a range of about 0.1 to about 2.0 weight percent.

15. A liquid composition consisting essentially of water in an amount within a range of about 95 to about 99.9 weight percent, an anionic surfactant in an amount within a range of about 0.001 to about 2.0 weight percent, and polyol in an amount within a range of about 0.1 to about 3 weight percent.

16. The liquid composition of claim 15 wherein the anionic surfactant is sodium lauryl sulfate (SLS).

17. A method for forming a liquid composition suitable for cleaning and disinfecting, the method comprising:

forming a solution by mixing water in an amount within a range of about 95 to about 99.9 weight percent, surfactant in an amount within a range of about 0.001 to about 2.0 weight percent, and polyol in an amount within a range of about 0.1 to about 3 weight percent;

forming a chlorine-dioxide-generating (CDG) composition; and placing an amount of the CDG composition in the solution, thereby generating free chlorine dioxide therein, wherein the amount of the CDG composition is suitable for generating chlorine dioxide in an amount within a range of about 0.1 to about 3000 weight parts per million in the liquid composition.

18. The method of claim 17 wherein the surfactant is an anionic surfactant.

19. A liquid composition comprising water in an amount within a range of about 95 to about 99.9 weight percent, surfactant in an amount within a range of about 0.001 to about 2.0 weight percent, and polyol in an amount within a range of about 0.1 to about 3 weight percent, and a compound providing a source of active chlorine.

20. The liquid composition of claim 19 wherein the compound is chlorine dioxide, and wherein the chlorine dioxide is present in an amount within a range of about 0.1 to about 3000 weight parts per million.

21. A liquid composition consisting essentially of water in an amount within a range of about 95 to about 99.9 weight percent, surfactant in an amount within a range of about 0.001 to about 2.0 weight percent, and polyol in an amount within a range of about 0.1 to about 3 weight percent, and a compound providing a source of active oxygen.

22. The liquid composition of claim 21 wherein the compound is hydrogen peroxide, and wherein the hydrogen peroxide is present in an amount within a range of about 0.05 to about 0.5 weight percent.

* * * * *